US007513986B2

(12) United States Patent
Albrecht et al.

(10) Patent No.: US 7,513,986 B2
(45) Date of Patent: Apr. 7, 2009

(54) METHOD AND DEVICE FOR LOCALLY REMOVING COATING FROM PARTS

(75) Inventors: Anton Albrecht, Andechs-Erling (DE); Armin Eberlein, Untermeitingen (DE); Karsten Gold, Stade (DE); Albert Schneider, München (DE)

(73) Assignee: MTU Aero Engines GmbH, Munich (DE)

( * ) Notice: Subject to any disclaimer, the term of this patent is extended or adjusted under 35 U.S.C. 154(b) by 255 days.

(21) Appl. No.: 10/480,828

(22) PCT Filed: Apr. 19, 2002

(86) PCT No.: PCT/DE02/01447

§ 371 (c)(1),
(2), (4) Date: Jun. 15, 2004

(87) PCT Pub. No.: WO02/103088

PCT Pub. Date: Dec. 27, 2002

(65) Prior Publication Data

US 2004/0244910 A1 Dec. 9, 2004

(30) Foreign Application Priority Data

Jun. 14, 2001 (DE) ..... 101 28 507

(51) Int. Cl.
*B23H 9/00* (2006.01)
*C23F 1/00* (2006.01)
*C25F 3/00* (2006.01)

(52) U.S. Cl. ..... 205/668; 205/674; 205/686; 204/224 R; 216/11; 216/83; 216/90; 216/96; 216/100; 216/108

(58) Field of Classification Search ..... 205/115, 205/117

See application file for complete search history.

(56) References Cited

U.S. PATENT DOCUMENTS

| | | | | | |
|---|---|---|---|---|---|
| 3,352,770 | A | * | 11/1967 | Crawford et al. | 205/654 |
| 3,637,468 | A | * | 1/1972 | Icxi et al. | 205/118 |
| 4,142,954 | A | | 3/1979 | Lucas | 204/146 |
| 4,159,934 | A | * | 7/1979 | Kadija | 204/224 R |
| 4,522,692 | A | * | 6/1985 | Joslin | 205/653 |
| 4,632,740 | A | * | 12/1986 | Operschall et al. | 205/668 |
| 4,655,881 | A | * | 4/1987 | Tezuka et al. | 205/104 |
| 4,830,719 | A | * | 5/1989 | Adams et al. | 205/663 |
| 4,997,529 | A | | 3/1991 | Totsuka et al. | 204/15 |
| 5,076,897 | A | * | 12/1991 | Wride et al. | 205/110 |

(Continued)

FOREIGN PATENT DOCUMENTS

DE 29512385 11/1995

(Continued)

OTHER PUBLICATIONS

German Office Action dated Mar. 7, 2005 with English translation.

*Primary Examiner*—Anita K Alanko
(74) *Attorney, Agent, or Firm*—Crowell & Moring LLP

(57) ABSTRACT

A method and a device for locally removing coatings from components. An absorbent medium supplied with a coating removal liquid is brought into contact with one or more areas of a component from which a coating is to be removed.

24 Claims, 2 Drawing Sheets

U.S. PATENT DOCUMENTS

| | | | | | |
|---|---|---|---|---|---|
| 5,160,590 | A | * | 11/1992 | Totsuka et al. | 205/152 |
| 5,277,785 | A | * | 1/1994 | Van Anglen | 205/117 |
| 5,389,228 | A | * | 2/1995 | Long et al. | 205/110 |
| 5,437,724 | A | * | 8/1995 | Dansereau et al. | 118/76 |
| 6,165,345 | A | * | 12/2000 | Updegrove et al. | 205/717 |
| 2003/0141201 | A1 | * | 7/2003 | Basol | 205/668 |

FOREIGN PATENT DOCUMENTS

| | | | | |
|---|---|---|---|---|
| EP | 0 713 957 | A1 | | 5/1996 |
| GB | 2270644 | A | * | 3/1994 |
| JP | 54121237 | A | * | 9/1979 |
| JP | 57117222 | A | * | 7/1982 |
| JP | 59-211576 | | | 11/1984 |

* cited by examiner

METHOD AND DEVICE FOR LOCALLY REMOVING COATING FROM PARTS

CROSS-REFERENCE TO RELATED APPLICATIONS

This application claims the priority of German Patent document 101 28 507.8, filed Jun. 14, 2001, (PCT International No. PCT/DE02/01447, filed Apr. 19, 2002, published in German as WO/02/103088), the disclosure of which is expressly incorporated by reference herein.

BACKGROUND AND SUMMARY OF THE INVENTION

The invention relates to a method for locally removing coatings from components, in particular gas-turbine or aircraft-engine components which have one or more coatings at least in certain areas.

Components of internal combustion engines, such as gas turbines, have a wide variety of coatings. For removing such coatings, for example after damage during operation, so-called immersion methods are known. In these, the component is completely immersed in an electrochemical bath for removing coatings, so that not only the coated surfaces but all the surfaces of the component (base material, coatings etc.) are subjected to a material attack. A selective immersion of the coated areas of the component is often restricted by the component geometry, i.e. the lack of accessibility to the coating. The use of covers for the uncoated areas of the component leads to interfacial reactions due to restricted wettability, and consequently to an uncontrolled attack on the uncoated areas.

An object of the present invention is to provide a method with which components provided with coatings can have their coatings removed selectively or restricted to local areas. Moreover, a device for selectively or locally removing coatings from components is to be provided.

These and other objects and advantages are achieved by the method according to the invention in that a component having a coating on at least certain areas is provided, an absorbent medium is provided, the medium is supplied with a coating removal liquid and the medium containing the coating removal liquid is brought into contact with the area of the component from which the coating is to be removed.

Preferably, coatings can be removed from components without uncoated surfaces or the base material of the component being attacked by the coating removal liquid or stripping liquid. Desirably, the coatings are not removed completely, but only the damaged areas. If the component also has other coatings, not all the coatings have to be removed, but preferably just the damaged ones. This leads to savings of time and costs in the repair procedure. In addition, less coating removal liquid is required than in the case of the immersion method. Furthermore, no additional covers are required for areas of the component from which coatings are not to be removed. The local removal of coatings according to the invention has the effect that the base material underneath the coating and the base material in uncoated areas of the coating is not attacked, or only within the permissible limit values.

In another embodiment, absorbent cotton or a sponge or a porous material which may be ceramic or synthetic, for example synthetic fibrous material, may be provided as the medium. The medium absorbs the liquid and stores it, so that coatings are removed from the component when it comes into contact with the medium. It is a general prerequisite for this invention that the medium is resistant to the coating removal liquid. The medium is in this case continuously supplied with coating removal liquid.

The coating removal liquid can preferably be continuously supplied to the medium, for example by an inflow or drip feeding device and corresponding controller, whereby the area of the component from which the coating is to be removed is constantly wetted with coating removal liquid and has the effect of attacking or dissolving the coating. The constant flow, i.e. inflow and outflow, of the liquid ensures that the composition of the coating removal liquid which wets the area from which the coating is to be removed remains substantially the same.

The contact between the medium containing the coating removal liquid and the area of the component from which the coating is to be removed can be maintained over a period of time which may last from a few minutes to several hours, depending on the thickness and type of coating, and in particular may last for 12 to 48 hours.

The medium can preferably be held in a liquid-impermeable receptacle, the shape of which can be formed in a way corresponding to the shape of the component in its area from which the coating is to be removed. The receptacle is preferably formed in such a way that the medium between the receptacle and the area of the component from which the coating is to be removed is in close contact with the area of the component from which the coating is to be removed during the coating process.

The receptacle may have at least one inlet, by which the medium is supplied with coating removal liquid.

Depending on the type of coating, an acid or a caustic solution or salt solution may be provided as the coating removal liquid. The local removal of coating may take place chemically or electrochemically, so that a chemically active or electrochemically active coating removal liquid may be provided as the coating removal liquid.

The method may be used on metallic components, provided with a coating at least in certain areas, of stationary gas turbines or aircraft engines, such as for example a blade or an integrally bladed rotor carrier. A wide variety of coatings, such as coatings protecting against high-temperature corrosion or oxidation or coatings protecting against wear, such as blade tip claddings containing hard particles, can be selectively or locally removed in this way.

By heating the coating removal liquid above room temperature, the time period of the coating removal operation can be reduced, it being possible to achieve good results with shorter coating removal time periods at a temperature of the coating removal liquid above 40° C., and in particular in the range from 40 to 60° C.

The medium and the area of the component from which the coating is to be removed may be moved in relation to each other. In this way, fine residues on the coating can be removed or surfaces of the coating still to be removed can be exposed to improve the superficial reactions. Moreover, the area from which the coating is to be removed is wetted more uniformly with the coating removal liquid and its constant replacement is improved. This leads to a reduction of the coating removal time period.

In another embodiment, an object of the invention is achieved by way of at least one holding device for a component having a coating at least in certain areas, and at least one receiving device for an absorbent medium containing a coating removal liquid, the holding device and/or the receiving device being positionable in such a way that the medium containing the coating removal liquid makes contact with the area of the component from which the coating is to be removed.

The receiving device can preferably have at least one inlet for the coating removal liquid and at least one outlet for liquid, so that a constant composition of the coating removal liquid coming into contact with the areas from which coatings are to be removed is ensured.

Furthermore, the device can preferably have a number of receiving devices for the simultaneous removal of a number of coatings or coating areas of a component or a number of components. For example, in the case of an integrally bladed rotor carrier of a gas turbine, the blade tip claddings of a number of blades can be removed simultaneously, without the uncoated surfaces of the rotor carrier being attacked by the coating removal liquid. Similarly, the blade tip claddings of a number of individual blades of gas turbines can be removed by the corresponding number of receiving devices simultaneously.

In yet another embodiment involving an electrochemical coating removal method, the component may be anodically connected or subjected at times, for example at regular intervals, to anodic-cathodic pole reversal or pulsing. The pulsing/pole reversal may also take place over the entire coating removal time period. The pulsing/pole reversal allows specific atoms or molecules, such as for example hydrogen, to be deposited on the surface of the component area from which the coating is to be removed, where they react and speed up the coating removal process. Furthermore, in the case of electrochemical coating removal, the controlling of the current and voltage is adapted to the base material of the component and to the coating to be removed (type, thickness, size).

Further refinements of the invention are described in the subclaims.

BRIEF DESCRIPTION OF THE DRAWINGS

The invention is explained in more detail below on the basis of a respective exemplary embodiment with reference to a respective drawing, in which.

DETAILED DESCRIPTION OF THE EMBODIMENTS

Figure 1:
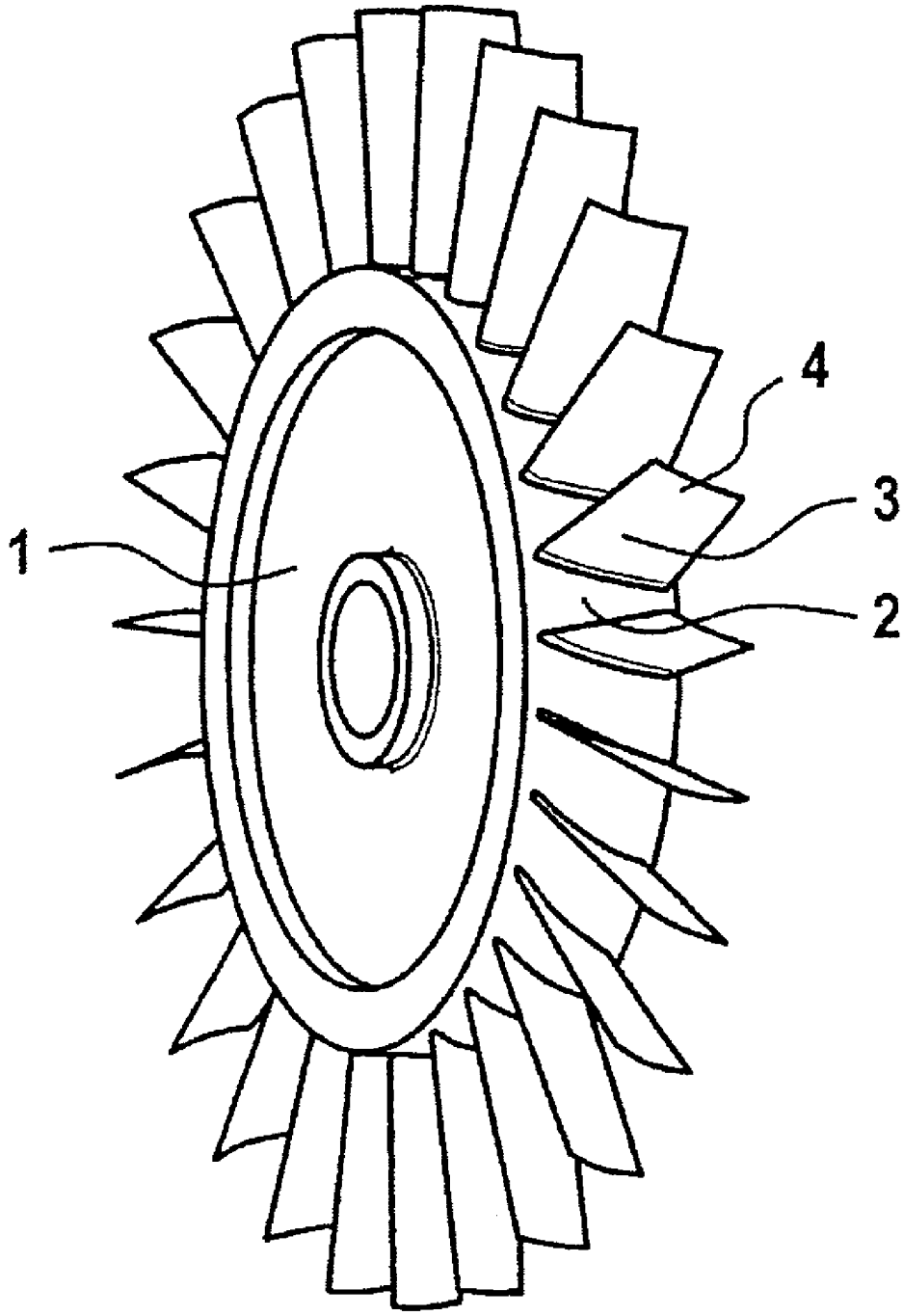
FIG. 1 shows an integrally bladed rotor carrier of a gas turbine.

FIG. 1 shows an integrally bladed rotor 1 of a gas turbine or an aircraft engine, on the circumferential surface 2 of which a multiplicity of blades 3 are integrally provided. The rotor 1 is a metallic component. In the present case, the rotor 1 and the blades 3 consist of a titanium alloy. The blades 3 are provided at their blade tips 4 with blade tip claddings (not represented), which contain hard particles. During the operation of the gas turbine, local damage may occur to these blade tip claddings on individual blades 3.

In an embodiment of the method for locally removing coatings, the rotor 1 is held in a holding device (not shown) and positioned in such a way that the area of the blade tip cladding of a blade 4 from which the coating is to be removed is brought into contact with a medium containing a coating removal liquid, is wetted with coating removal liquid and has its coating removed in an electrochemical process. Dilute sulfuric acid is used as the coating removal liquid. The medium is introduced into a receiving device, the form of which is adapted to the blade tip 4 in such a way that the latter is completely covered by the medium containing the sulfuric acid. In the present case, the medium consists of a synthetic fibrous material.

The device for carrying out the method for locally removing coatings from the rotor 1 comprises a current source (not represented), to which the rotor 1 is anodically connected. The device also comprises a cathode made of platinized titanium, which likewise makes contact with the medium with the coating removal liquid. The electrochemical coating removal takes place at room temperature with a voltage of less than 10 volts being applied, over a time period of 24 to 48 hours. If the temperature of the coating removal liquid is increased by a heat source to 40 to 60° C., under the same boundary conditions the time period is reduced to 12 to 15 hours. In this case, coating removal liquid serving as an electrolyte is continuously supplied to the medium, wets the area on the blade tip 4 of the blade 3 from which the coating is to be removed and has the effect of locally dissolving the damaged blade tip cladding.

By providing a number of receiving devices which respectively contain medium with the electrolyte sulfuric acid, damaged blade tip claddings can be removed on a number of blades 3 simultaneously.

Alternatively, the method described above can be carried out without a current source and cathode, if the medium in the receiving device is supplied with a chemically active coating removal liquid, which dissolves the damaged blade tip claddings by a chemical process.

Figure 2:
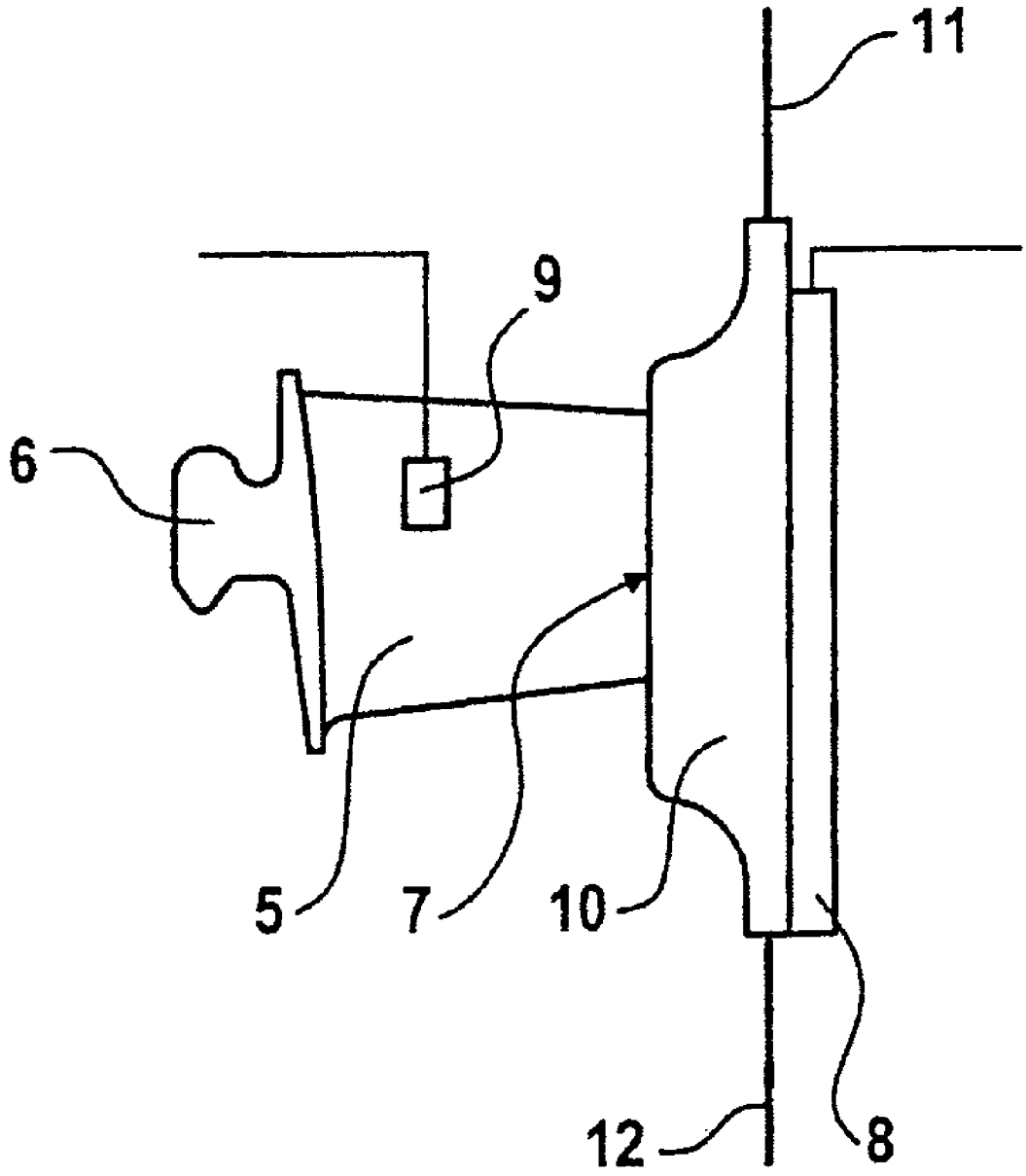
FIG. 2 shows an exemplary embodiment of a device for locally coating a component, with which the method for locally removing coatings from components can be carried out.

FIG. 2 shows an exemplary embodiment with a single blade 5, which is releasably fastened by its blade root 6 together with a multiplicity of further blades on the circumference of a blade carrier of a gas turbine. The single blade 5 (or other components from which coatings are to be locally removed) consists of a Ti-based alloy. Alternatively, the single blade 5 could also consist for example of a Ni- or Co-based alloy. The blade 5 has at its blade tip 7 a coating in the form of a blade tip cladding, which has hard particles.

For the electrochemical removal of this blade tip cladding, which has been damaged at least partly during operation, a current source (not shown) and a cathode 8 are provided. The single blade 5 is anodically connected to the current source via the contact 9. A receiving device 10 for the medium has an inlet 11 for a coating removal liquid, which is an electrolyte. In the interior of the receiving device 10 there is provided an absorbent medium, which absorbs the electrolyte and is in contact both with the blade 5 and the cathode 8. The electrochemical coating removal takes place by applying a voltage at room temperature over a time period of 12 to 48 hours. Dilute sulfuric acid as the electrolyte is constantly supplied to the absorbent medium via the inlet 11 and wets both the area at the blade tip 7 from which the coating is to be removed and the cathode 8. Liquid is removed from the receiving device 10 or the absorbent medium via the outlet 12.

In an alternative exemplary embodiment, the absorbent medium provided in the receiving device 10 is supplied with chemically active coating removal liquid, by which the damaged blade tip cladding is locally attacked or dissolved within a chemical process.

In various embodiments of the chemical or electrochemical method, it is the coated areas of the component that are brought into contact with the chemically active or electrochemically active coating removal liquid, with the result that the uncoated component areas are not subjected to any surface attack without additional covering. By providing a number of receiving devices containing the absorbent or liquid-absorbing medium, all the damaged blade tip claddings of an integrally bladed rotor can be chemically or alternatively electrochemically removed in one procedure.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method for locally removing coatings from components, comprising:

providing a turbine component having a blade tip and a coating on at least said tip of said component;

providing an absorbent medium contained within an interior of a receiving device;

supplying the medium with a coating removal liquid by way of an inlet to the interior of the receiving device;

inserting said tip of said component into the interior of the receiving device so as to bring said tip into contact with the medium containing the coating removal liquid so that the coating is locally electrochemically removed from only said tip of said component; and removing the coating removal liquid from the medium by way of an outlet from the interior of the receiving device while retaining the medium in said interior.

2. The method of claim 1, wherein absorbent cotton, a sponge, or a porous material is provided as the medium.

3. The method of claim 2, wherein the porous material is ceramic or synthetic.

4. The method of claim 1, wherein the coating removal liquid is continuously supplied to the medium.

5. The method of claim 1, further comprising maintaining contact with the medium containing the coating removal liquid for a period of time.

6. The method of claim 5, wherein the period of time is from about 2 minutes to about 48 hours.

7. The method of claim 5, wherein the period of time is from about 12 hours to about 48 hours.

8. The method of claim 1, wherein the absorbent medium is positioned and retained in a receptacle forming the receiving device.

9. The method of claim 8, wherein the shape of the receptacle corresponds to the shape of the tip from which the coating is to be removed.

10. The method of claim 1, wherein the coating removal liquid is an acid, a caustic solution, a salt solution, or a mixture thereof.

11. The method of claim 10, wherein the acid is hydrochloric acid, sulfuric acid, or a mixture thereof.

12. The method of claim 1, wherein the coating is removed chemically and electrochemically from the tip by contact with the coating removal liquid.

13. The method of claim 12, wherein the coating removal liquid is both chemically and electrochemically active.

14. The method of claim 12, further comprising providing a cathode at a distance from the component, and contacting the cathode with the coating removal liquid, wherein the component is anodically connected or subjected to anodic-cathodic pulsing.

15. The method of claim 1, wherein the component from which the coating is to be removed is a metallic or ceramic gas turbine component.

16. The method of claim 15, wherein the gas turbine component is a blade or an integrally bladed rotor carrier.

17. The method of claim 1, wherein the temperature of the coating removal liquid is at least room temperature.

18. The method of claim 17, wherein the temperature of the coating removal liquid is at least 40° C.

19. The method of claim 17, wherein the temperature of the coating removal liquid is from about 40° C. to 60° C.

20. The method of claim 1, wherein the coating is a blade tip cladding.

21. The method of claim 1, further comprising moving, in relation to each other, the absorbent medium and the tip from which the coating is to be removed.

22. A device for locally removing coatings from turbine components by way of a method as recited in claim 1, comprising said receiving device containing said absorbent medium, said receiving device having a shape that corresponds to the shape of the tip from which the coating is to be removed; said inlet by which said coating removal liquid is supplied to the medium; said outlet by which said coating removal liquid is removed from the medium while the medium is retained in said interior, a current source to which the component is anodically connected or anodically-cathodically connected by pole reversal, and a cathode in contact with the absorbent medium.

23. The device of claim 22, wherein the receiving device is one of a plurality of receiving devices.

24. The device of claim 22, further comprising a heat source for heating the coating removal liquid.

* * * * *